United States Patent [19]

Catti et al.

[11] Patent Number: 5,012,661

[45] Date of Patent: May 7, 1991

[54] SHEET WORKPIECE BENDING MACHINE

[75] Inventors: Alberto A. Catti; Franco Sartorio; Stefano Vergano, all of Turin, Italy

[73] Assignee: Amada Company, Limited, Japan

[21] Appl. No.: 459,427

[22] Filed: Dec. 29, 1989

[30] Foreign Application Priority Data

Dec. 29, 1988 [IT] Italy ..... 68166 A/88

[51] Int. Cl.[5] ..... B21D 5/01

[52] U.S. Cl. ..... 72/21; 72/389; 72/452; 72/453.02; 72/27

[58] Field of Search ..... 72/389, 413, 453.02, 72/453.06, 453.07, 453.08, 446, 481, 21, 27, 31, 452; 100/231, 258 R, 258 A

[56] References Cited

U.S. PATENT DOCUMENTS 4,651,553 3/1987 Rhoades ..... 72/319

FOREIGN PATENT DOCUMENTS 051554 5/1982 European Pat. Off. .
3245755 6/1984 Fed. Rep. of Germany ..... 72/384
8910807 11/1989 PCT Int'l Appl. ..... 72/389
1063629 12/1983 U.S.S.R. ..... 100/237
888086 1/1962 United Kingdom .
1233448 5/1971 United Kingdom .
1405425 9/1975 United Kingdom .

*Primary Examiner*—David Jones
*Attorney, Agent, or Firm*—Wigman & Cohen

[57] ABSTRACT

A press including a frame which carries a pair of tool-holding beams lying in a common general plane. One of the beams carry a punch and the other a bending die. At least one of the beams is movable towards the opposing beam to perform a working stroke, and in the opposite direction. According to the invention, the movable beam is divided, at least effectively, into a number n of sections, n being equal to or greater than 2. The devices for moving the beam are constituted by n=1 servomotor units each of which is provided with a support coupled to the movable beam and is adapted to exert a force, through this support, for thrusting the movable beam towards the opposite beam during the working stroke. Two servomotor units are end units whose supports are coupled to respective ends of the movable beam. The other remaining servomotor is an intermediate unit whose support is situated in the transition zone between one section and another. If P is the total force thrusting the movable beam towards the opposing beam, each end unit is adapted to exert a thrust force of P/2(n−1) on the movable beam through its support. A position transducer is associated with each support and the servomotor units are subject to a common control processor having inputs connected to the transducers and outputs connected to the servomotor units. The processor is adapted to control each unit so that all the units impart identical movements and speeds of movement of their supports and to the movable beam.

6 Claims, 7 Drawing Sheets

IV
IV
nL
L
L

SHEET WORKPIECE BENDING MACHINE

BACKGROUND OF THE INVENTION

1. Field of the Invention

The present invention relates to a sheet-workpiece bending machine, and more particularly to a sheet workpiece bending machine capable of performing a precise bending operation in a sheet workpiece.

2. Description of the Prior Art

In sheet-metal bending presses used as sheet workpiece bending machines, the punch and the die, as upper and lower bending tools, are supported by beams as an apron. The beams are usually narrow but very deep so that they can resist deflection under the bending stress which, in machines of a certain length, is exerted by two fluidic cylinders situated at the ends of the movable beam. The flexural strength of the beams is very important since their deflection causes a difference in the distance between the punch and the die in the central section compared with the side sections of the beam. Even if it is limited, this deflection causes the sheet metal to be bent at an angle which is not constant along the length of the bend.

In very long bending presses, for bending pieces of sheet metal several meters long, the depths of the beam reach high values of the order of two meters or more. In fact, for a given central deflection, as the length of the beam increases, its moment of inertia must increase as the cube of the length of the beam.

This means that the machine is very high. Amongst other things, in a vertical machine, that is, of the most usual type, the considerable depth of the lower beam involves the need to form a well in the workshop floor to house the bulk of this beam and thus keep the working plane in an ergonomic position.

SUMMARY OF THE INVENTION

In view of the foregoing, it is therefore the first object of the present invention to provide a sheet workpieces, bending machine for bending long sheet workpiece, which achieves very precise bending, but in which the beams (apron) are not as deep as in the prior art.

It is another object of the present invention to provide a sheet workpiece bending machine which can be used with higher bending forces than those used in the prior art, but with a deflection of the beams which is equal to or preferably less than that to which the beams of prior-art presses are subject.

According to the present invention, these objects are achieved by means of a bending press which comprises; upper and lower bending tools having a long and narrow shape and movable relatively toward and away from each other, for bending a sheet workpiece interposed therebetween; at least three supporting frames each provided to lie within a plane of three planes perpendicular to the longitudinal direction of the bending tools, the supporting frames supporting, through apron members, the upper and lower bending tools in a manner such that the bending tools are movable relatively toward and away from each other; a driving force exerting means, each mounted on one of the supporting frames, for exerting a driving force on at least three sections in the longitudinal direction of the upper or the lower bending tools, in order to move the upper and the lower tools relatively toward and away from each other; and control means for controlling the driving force exerting means so that spacing between the upper and the lower tools, at least at the three sections of the bending tools, is maintained to be the same during actual bending operation.

BRIEF DESCRIPTION OF THE DRAWINGS

The invention will become clearer from a reading of the detailed description which follows with reference to the appended drawings, given purely by way of non-limiting example, in which.

DESCRIPTION OF THE PREFERRED EMBODIMENTS

Figure 1A:
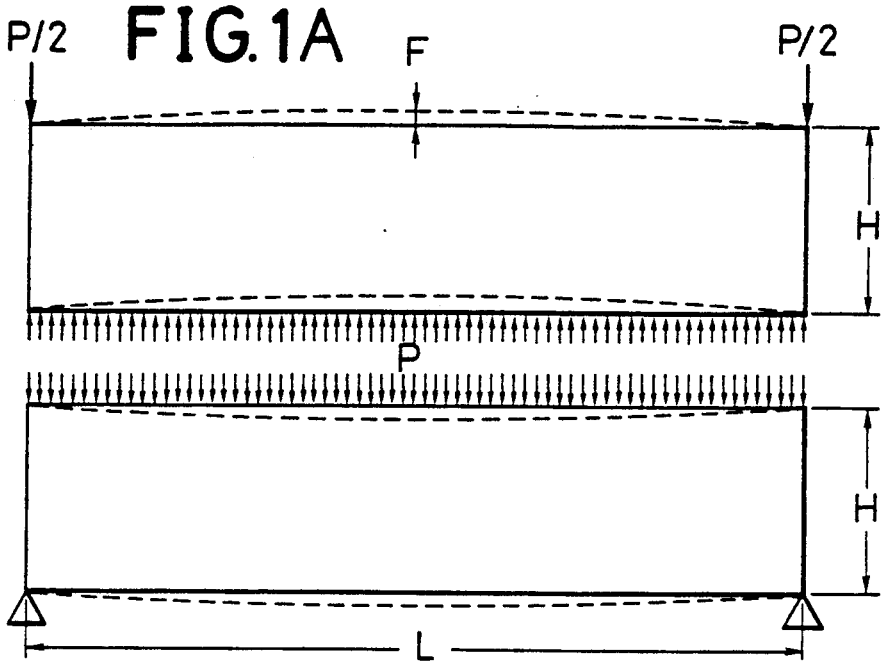
FIGS. 1A, B, C, are schematic diagrams showing the principle of the present invention.
Figure 1B:
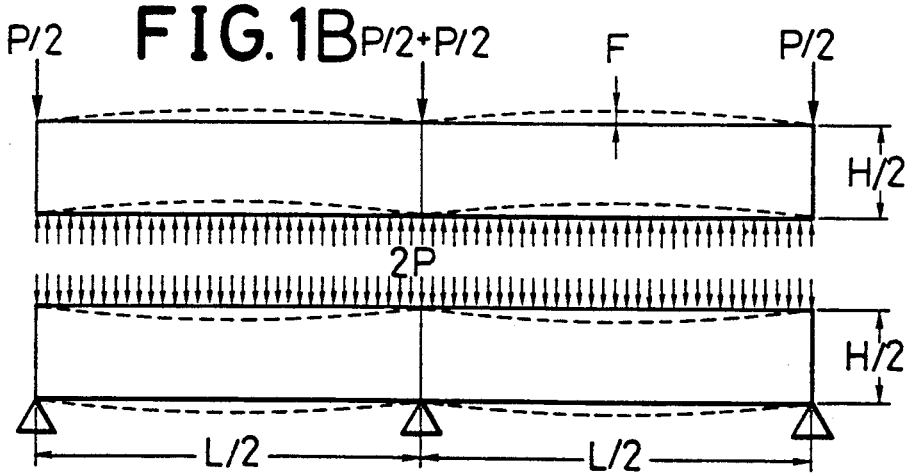
Figure 1C:
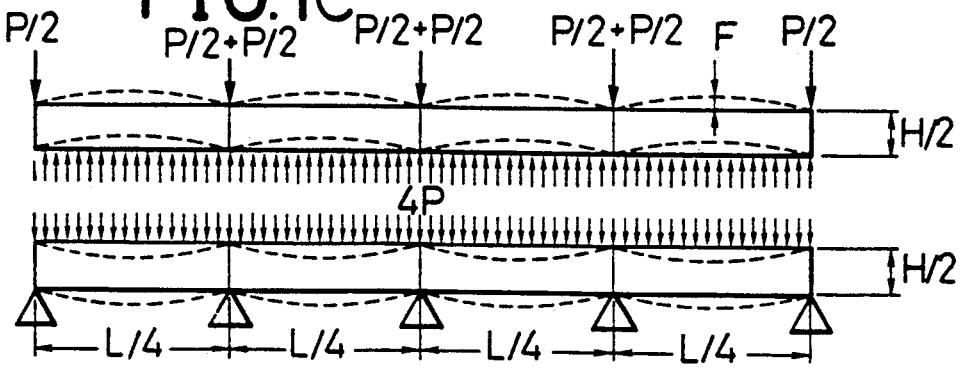

First, an explanation of the principle on which the invention is based will be given with reference to FIGS. 1A, 1B and 1C.

The deflection F of a beam (apron member) is governed by the well-known formula:

$$F = Ko\frac{PL^3}{I}$$

where:

F=the deflection of the beam
P=the total load on the beam
L=the length of the beam
I=the moment of inertia of the beam
Ko=a constant If the beam has a prismatic section, $$I = \frac{BH^3}{12}, \text{ so that } F = K1\frac{PL^3}{H^3};$$

where:

B=the breadth of the beam
H=the depth of the beam
K1=a constant

Obviously, for a given deflection F and breadth B of the beam, the depth H of the beam is proportional to L.

Therefore:

(1) given a bending press (FIG. 1A) of a certain length L, a total load P and a certain deflection F of the beam of a depth H, the same deflection F can be achieved (FIG. 1B) with a beam of half the depth H/2, if an additional load P is applied to the center of the machine and the lower and upper beams are each divided into two independent beams of a length L/2;

(2) the load can be further increased to 4P (FIG. 1C) and the height of the beams halved again (H/4) if a further division into two is carried out, and so on with further division into two.

A bending press of a considerable length can therefore be produced by an alignment of modular elements which are much smaller both in the dimensions of the beams and in the force exerted, provided that the ends of all the individual modules are moved simultaneously with great accuracy.

According to the present invention, this accuracy is achieved by virtue of the presence of a control processor which provides for the simultaneous movement, preferably with numerical control, of all the supports of the movable beams, that is, of the end supports and the intermediate support or supports, so that the microdisplacements $\delta s$ of all the supports and of the corresponding parts of the beam are identical to each other and all take place at the same time $\delta t$.

This type of control is an electronic technique known under various names ("electric shaft" or "linear interpolation" of the movement of various axes). As far as is known, up to now, this technique has been applied in known bending presses only for the control of two fluidic or electrical servo-operating cylinders situated at the ends of an undivided movable beam.

According to the invention, a movable beam may not even be divided physically, but may consist of a continuous beam fixed to each support. In this case, the beam and the supports constitute a statically indeterminate system.

If as is preferred, at least the movable beam is divided physically into successive separate modules, however, the or each intermediate support of this beam is coupled simultaneously to consecutive modules. In this case, each module and its supports constitute an isostatic system.

The beam opposite the movable beam is generally the lower beam. To advantage, if this beam is fixed or substantially fixed, as is often the case, it is also divided, at least effectively, like the movable beam, its supports, which act as reaction means, are fixed, and the fixed beam in any case also has a reduced depth. This characteristic offers the great advantage that it does not require the formation of a well in the workshop floor to house the bulk of the lower beam.

Figure 2:
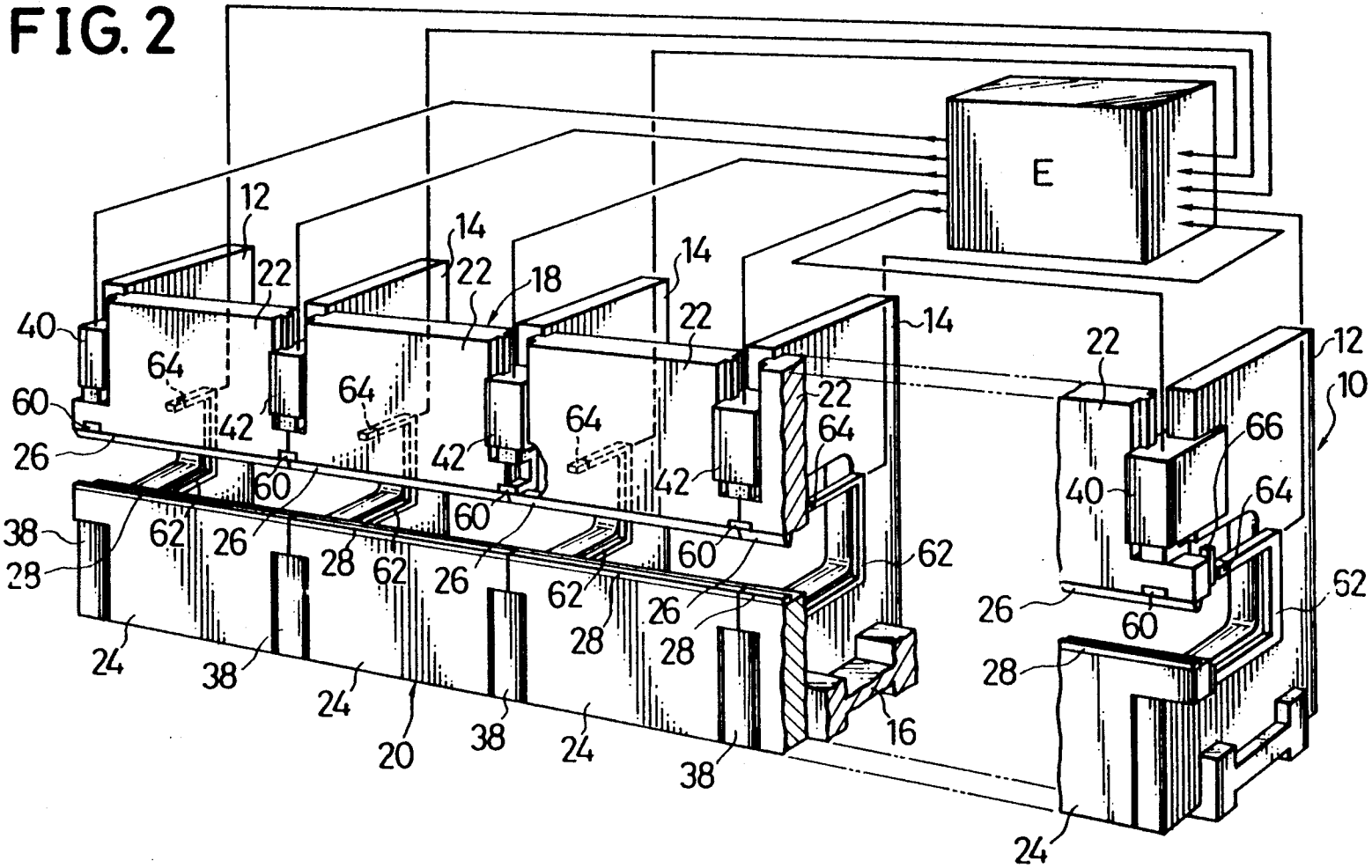
FIG. 2 is a shortened perspective view of one embodiment of a press according to the invention, in which the control processor is also shown schematically.
Figures 3, 4:
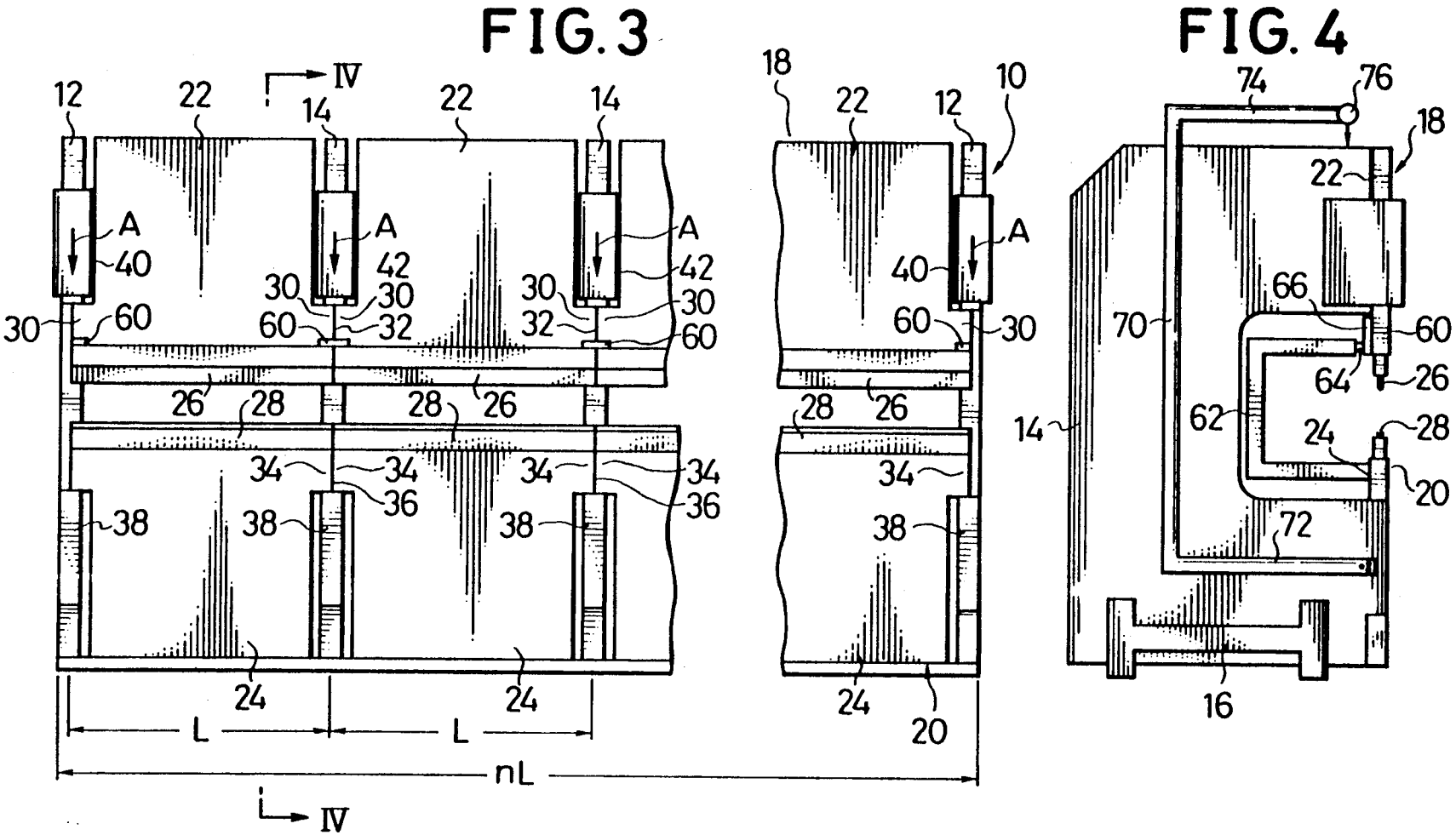
FIG. 3 is a schematic front elevational view thereof, also shortened.
FIG. 4 is a schematic cross-section thereof, taken in the vertical plane IV—IV of FIG. 3, in which a detail of a variant is also illustrated.

With reference to FIG. 2 to 4, a bending press includes a frame, generally indicated 10. According to the invention, the frame 10 is constituted essentially by a series of more than two vertical, C-shaped, steel structures. The end structures (supporting frames) are indicated 12 and the intermediate structures (supporting frame) 14. The structures 12, 14 are rigidly interconnected, amongst other things, by a longitudinal base member 16 which acts as a stiffening element.

The C-shaped structures 12, 14 support an upper tool-holder beam (apron member) 18 and a lower tool-holder beam (apron member) 20. These two beams 18, 20 lie in a common, vertical general plane.

FIGS. 2 to 4 show the most usual arrangement in which the lower beam 20 is fixed and the upper beam 28 is movable vertically in the general plane.

According to the invention, both the upper beam 18 and the lower beam 20, or at least the movable beam of the two, are divided into a number n of sections or modules. It should be understood that, in order to put the invention into effect, the number n must be equal to or greater than 2. In other words, in order to realize the invention, the frame 10 must include at least one intermediate structure such as 14.

The sections or modules (component members) of the upper beam 18 are indicated 22 and those of the lower beam 20 are indicated 24. The length L of each section 22 and 24 (FIG. 3) is a submultiple of the length nL of the respective beam 18, 20.

The lengths L also constitute the "spacing" between the structures 12, 14.

At the bottom and throughout the length, the upper beam 18 carries a corresponding series of V-shaped bending punches (upper bending tools) 26. At the top and throughout its length, the lower beam 20 carries a corresponding series of V-shaped bending dies (lower bending tools) 28 which cooperate with the punches 26.

Each section 22 of the upper beam 18 has end parts 30 (FIG. 3) which are recessed towards its punch 26. The lines or zones of separation or transition between one section 24 and another are indicated 36.

Each transition zone 32 and 36 is in the median plane of one of the structures 12, 14.

The end parts 34 of the modules 24 rest directly on rigid reaction supports constituted by the lower arms 38 of the C-shaped structures 12, 14. As will be understood, each module 24 is mounted isostatically, like a beam with two supports.

The C-shaped structures 12, 14 of the frame 10 carry motor-driven means for moving the movable beam 18. According to the invention, these movement means are constituted by $n+1$ servomotor units, one of which will be described with reference to FIG. 4.

The end servomotor units are indicated 40 and the intermediate ones 42.

The servomotor units 40 are arranged to raise and lower the end modules 22 only, whilst the units 42 are arranged to raise and lower two adjacent modules 22 together.

If the total thrust force which all the servomotors must exert on the movable beam 18 to carry out the bending is indicated P, the units 40 are dimensioned so as to be able to exert a downward thrust of $P/2(n-1)$, whilst the intermediate units 42 are dimensioned so as to be able to exert a downward thrust which is twice the above, that is $P/(n-1)$.

Figure 5:
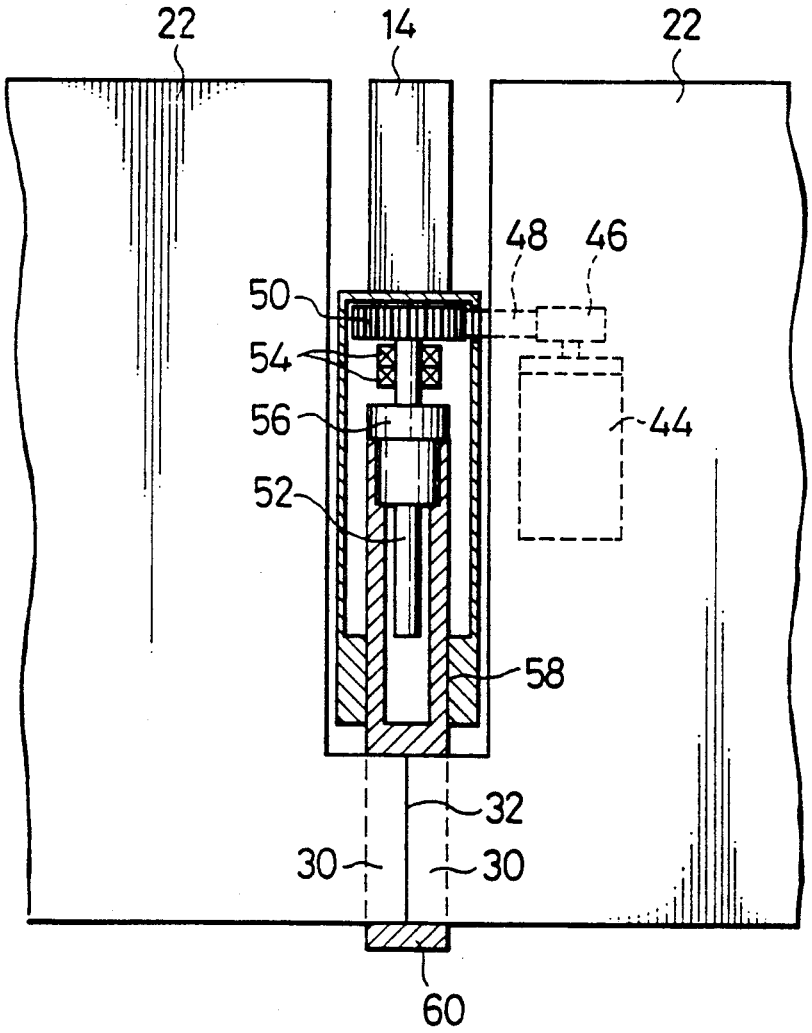
FIG. 5 is a partial, purely schematic view of one of the servomotor units of FIGS. 2 to 4, on an enlarged scale.

With reference to FIG. 5, each servomotor unit 42 (and each unit 40) comprises a numerically-controlled electric motor 44 fixed to the respective C-shaped structure 14 (or 12). The shaft of the motor 44 carries a driving gear 46 which (by way of example) drives a driven gear 50 by means of a toothed belt 48. The driven gear 50 is keyed to a screw shaft 52 of the ball type, the vertical axis of which coincides with the median plane of the respective structure 14 (or 12). The shaft 52 is supported by bearings 54 fixed to the structure 14 (or 12).

A female thread 56 cooperates with the shaft 52 and forms part of a strong movable element 58. The element 58 has a lower support part 60 which surrounds the recessed parts 30 of two adjacent modules 22 (or just the end part 30 in the case of an end unit 22).

As will be understood, each module 22 is mounted isostatically in the manner of a beam with two supports, the supports being constituted by the parts 60.

As illustrated in FIG. 4, a rigid, auxiliary C-shaped structure 62 is situated in correspondence with each C-shaped structure 14 (and 12), within the C-shaped recess of that structure, and has a lower arm which is fixed to one of the ends of one of the modules 24 of the lower beam 20 and an upper arm which carries the detector element of a position transducer. This detector element, indicated 64, is preferably an opto-electronic reader.

A reference element in the form of a vertical optical line 66 is fixed to the beam 18 in correspondence with each support 60.

The readers 64 are also shown in FIG. 2. As can be seen, they are connected to the same number of inputs of an electronic processor E. The processor E processes the position signals which are supplied thereto by the readers 64 and supplies numeric output control signals to all the servomotors 44.

As already stated in introduction to the present description, the processor E behaves like a so-called "electric shaft" and carries out a "linear interpolation" of the movement of the various devices 58 so that the vertical microdisplacements s of all the devices 58 and of all the ends 30 of the modules 22 are identical to each other and take place at the same time $\delta t$. The servosystem which comprises the transducers 64–66, the processors E and the servomotors 44 is not affected by the deformations of the structures 12, 14, by virtue of the mounting of the detectors 64 on the auxiliary structures 62 which, from the point of view of the deformations, are independent of the structures 12, 14 of the frame 10.

As will be understood, with a solution like that illustrated in FIGS. 2 to 5, bending presses of considerable length and total force can be produced with the use of beams of moderate depth and supports capable of exerting forces which are only a fraction of the total. As will also be understood, presses of this type do not require the formation of wells in the workshop floor, by virtue of the limited depth of the lower beam 20.

In practice, it is possible to produce a press in which a lower beam of limited depth, such as 20, is continuous, that is, divided only effectively into sections such as 24. This beam will differ from a modular fixed beam only in that it has more than two structures for connection to the upper beam and can therefore have a smaller depth than would be necessary for a beam supported only at its ends. In this case, the longitudinal member 16 will contribute to the rigidity of the assembly, with the continuous lower beam, or may be completely omitted.

An upper beam such as 18 may also be a single continuous beam as long as the machine and of a smaller depth than a beam with only two end supports. In this case also, compared with a modular upper beam, this continuous beam, which is divided effectively into sections, will behave in a statically indeterminate manner, being provided with several supports such as 60.

In the case of a continuous movable upper beam, it is necessary to provide each of the C-shaped structures, such as 12 and 14, with a further auxiliary detection structure. One of these structures is illustrated schematically at 70 in FIG. 4. It is C-shaped with a lower arm 72 fixed to the lower arm of the structure 14 (or 12) and an upper arm 74 which carries a transducer 76 connected to a respective input (not shown) of the processor E. The transducer 76 measures the deformations of the respective C-shaped structure 14 (or 12) under load. In the case of the statically indeterminate system of the continuous upper beam, this measurement is essential for identifying the zero position, when the punches 26 and dies 28 are in contact, for the servosystem of each of the C-shaped structures 12 and 14. In fact, in this case, the zero position must not only correspond with the condition in which the punch and die are in contact (without a metal sheet interposed), but this zero position must also correspond to a load (that is, a deformation) which is identical for all the intermediate sections of the beam and, for the end sections, to a load equal to half that of the intermediate sections.

Another embodiment of the invention will now be described with reference to FIGS. 6 to 9.

The embodiment of FIGS. 6 to 9 has certain characteristics which form part of another patent application for "A sheet workpiece bending machine", filed by the same Applicant concurrently herewith in which, in particular, different mechanisms govern the approach and bending stages. The bending press includes a pair of C-shaped structures (first supporting frames) 100. A lower fixed beam (fixed apron member) 102 carrying a die (lower bending tool) 104 is fixed to the lower arm of the structure 100.

An upper movable beam (movable apron member) 106 carrying the punch (upper bending tool) 108 is guided only by the upper arms of the structure 100. In the present case, it is assumed that the two beams 102 and 106 are continuous but modular beams could be involved, as in FIGS. 1 and 2.

Figure 6:
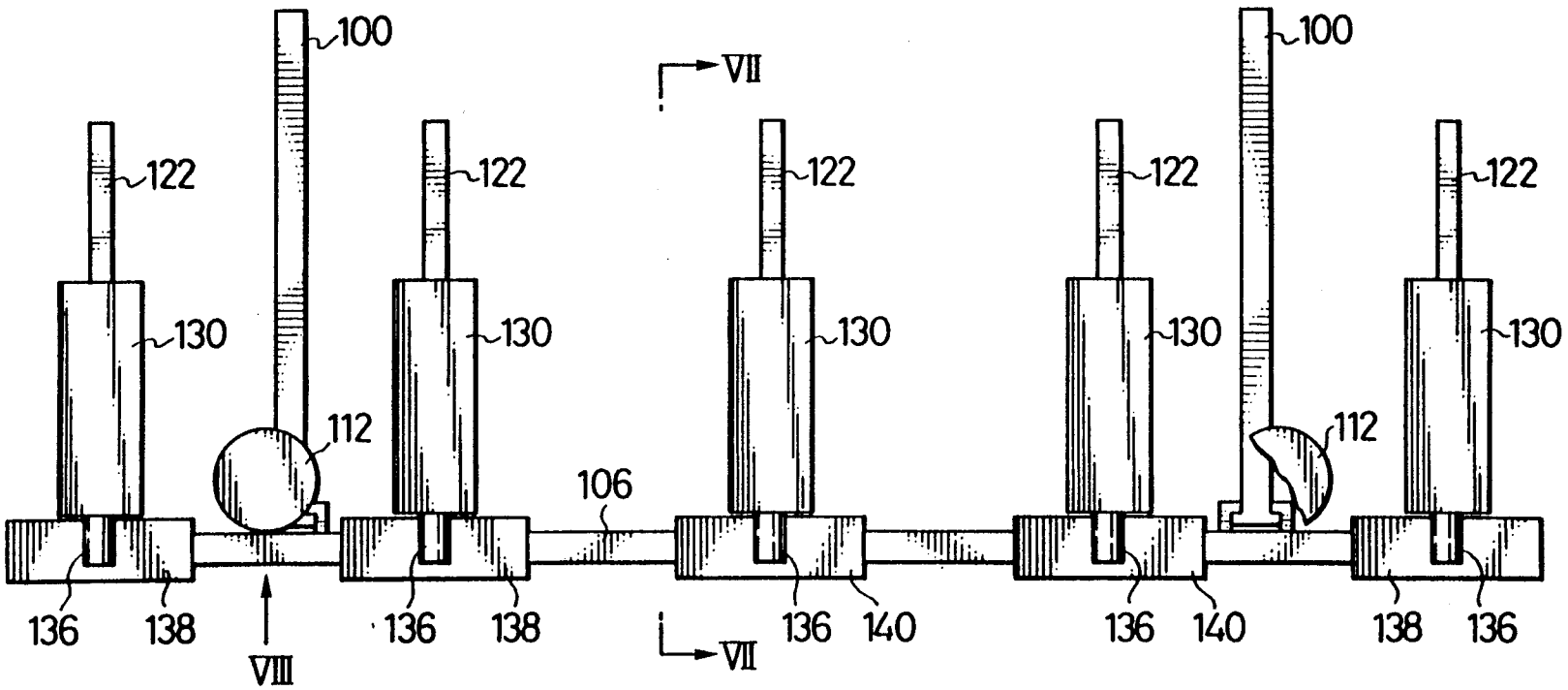
FIG. 6 is a schematic plan view from above of a bending press according to another embodiment of the invention.
Figure 8:
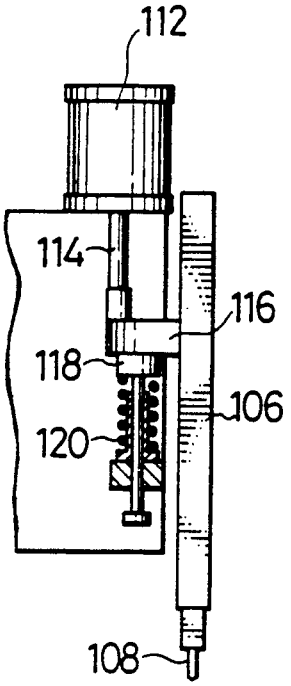
FIG. 8 is a schematic partial elevation taken on the arrow VIII of FIG. 6.

As shown in FIGS. 6 and 8, the top of each structure 100 carries a double-acting hydraulic or pneumatic actuator 112 having a vertical axis and all-or-nothing operation. A lower rod 114 of each actuator 112 carries a bracket 116 from which the movable beam 106 is suspended.

The two actuators 112, one for each structure 100, are operated in unison to implement the single approach stroke of the punch 108 towards the die 104 for the bending, and its return stroke after the bending.

Upon completion of the approach stroke, the bracket 116 bears on the end-of-travel stop constituted by a support 118 which yields against the force of a spring 120. The spring 120 is preloaded so as to support the weight of the entire movable component of the beam 106.

The press also includes a plurality $(n+1)$ of at least three equidistant C-shaped structures (second supporting members) 122 provided for the bending stage only, according to the principles described and illustrated in the aforementioned patent application of the same date.

Each of these C-shaped structures 122 is mounted isostatically, for example, on a horizontal pin 124 fixed to the lower beam 102, as shown. If desired, the C-shaped structures 122 may be mounted on the lower beam 102, free to rotate about the horizontal pin 124. Its weight is balanced by a respective spring 126 so that the upper arm of the structure 122 is kept in contact with the upper movable beam 106 by means of a roller 128.

The upper arm of each C-shaped structure 122 carries a reaction unit, generally indicated 130. The unit 130 comprises a hydraulic or pneumatic actuator 138 which has all-or-nothing operation and a horizontal rod 134 carrying a reaction bar of bolt 136.

In correspondence with each bolt 136, the movable beam 106 carries a servomotor unit which will be described below with reference to FIG. 9.

Figure 7:
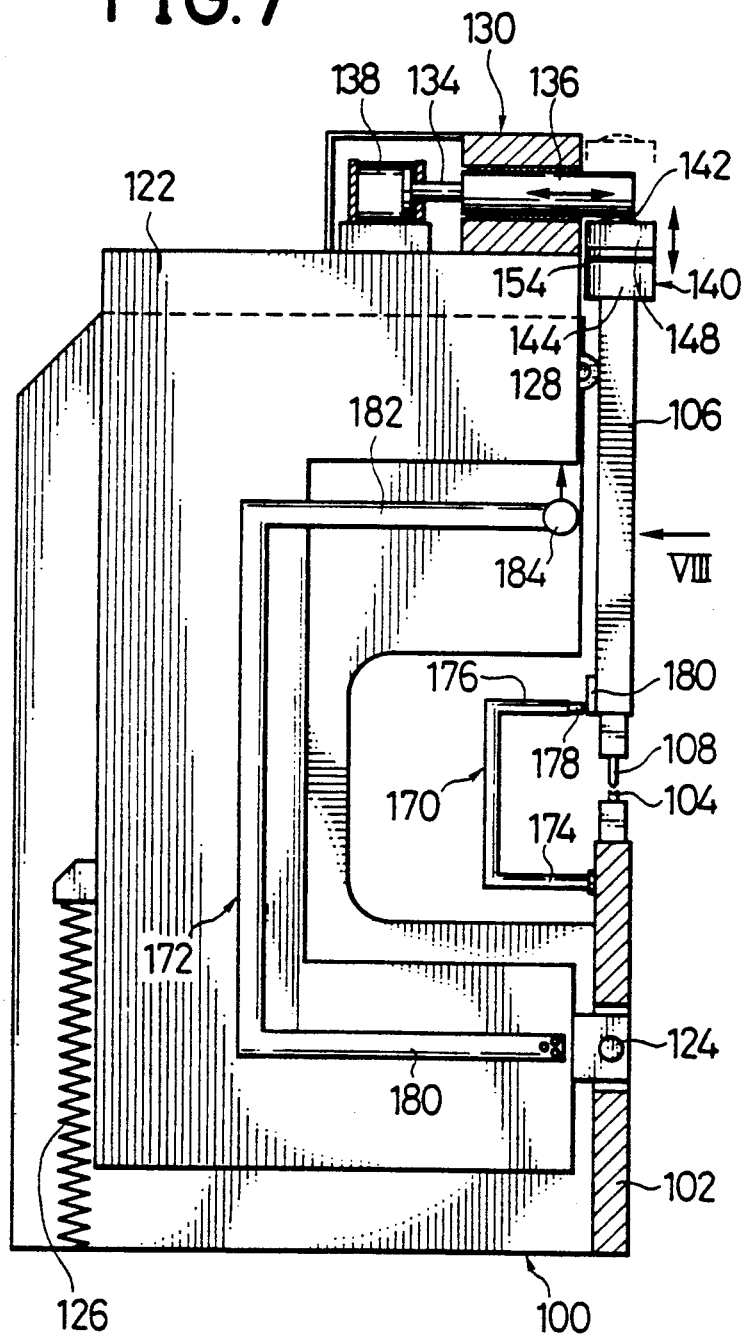
FIG. 7 is a schematic cross-section taken in the vertical plane VII—VII of FIG. 6, on an enlarged scale.

In FIG. 7, the position of a servomotor unit 140 (or 138) at the end of its approach stroke is shown in continuous outline and its position at the end of its return stroke is shown in broken outline.

Each unit 140 (and 138) has a spherical cap 142 at its top. When the unit 140 has reached the end of its approach stroke, the bolt 136 is advanced to the position shown in FIG. 7, so as to prevent the unit and the beam 106 from returning upwardly.

Figure 9:
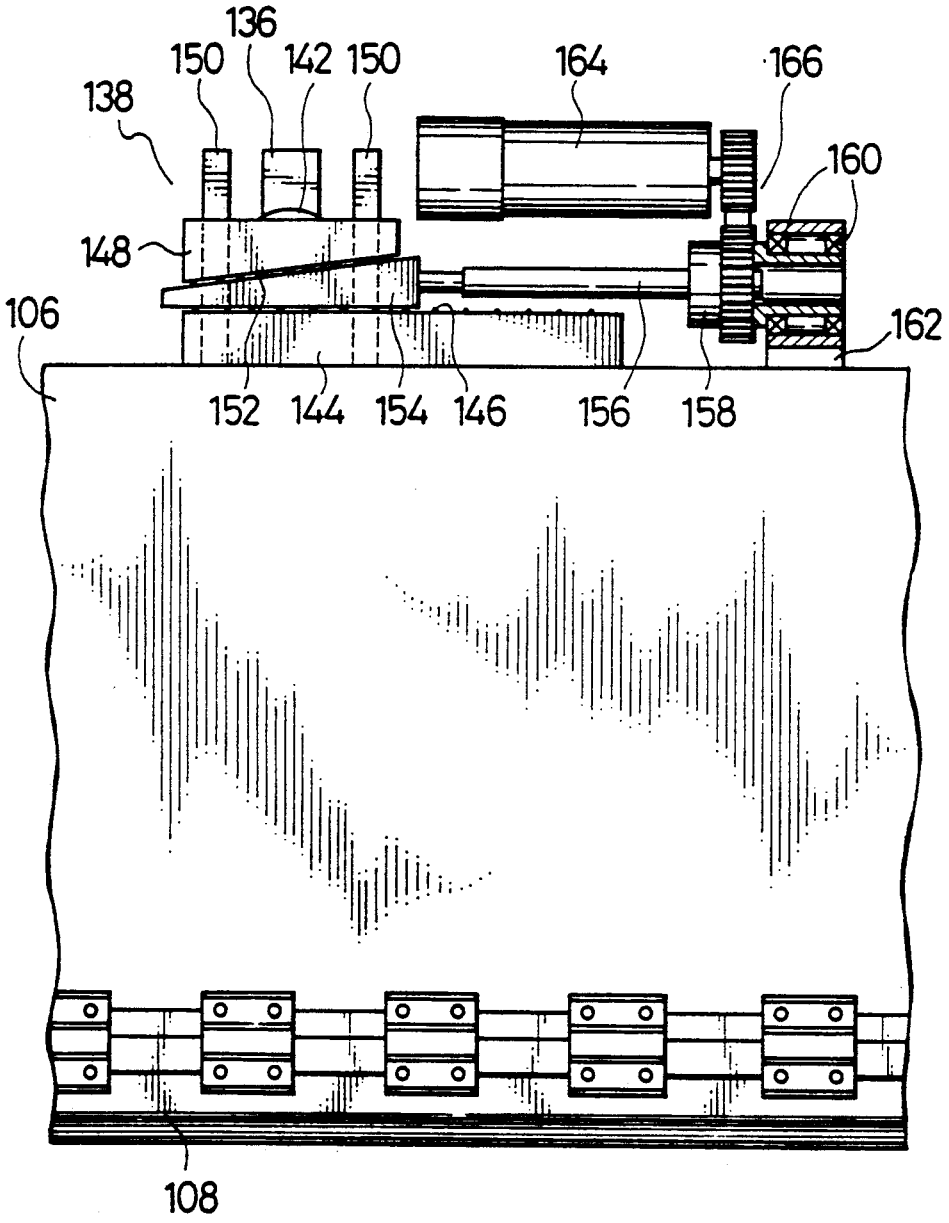
FIG. 9 is a schematic front elevational view taken on the arrow IX of FIG. 7.

With reference to FIG. 9, each servomotor unit 140 (and 138) includes a lower block or support 144 which is fixed to the top of the movable beam 106 in correspondence with one of the structures 122. This block 144 has an upper wedging surface 146 constituted by a roller table. Another block 148, of which the cap 142 forms a part, is coupled for vertical sliding in vertical guides 150 also fixed to the movable beam 106. The block 148 has an inclined wedging surface 152 which faces the surface 146 and is also constituted a roller table.

A corresponding wedge 154 is situated between the two wedging surfaces 146 and 152. The wedge 154 is fixed to an operating shaft 156 in the form of a ball screw.

A female thread 158 cooperates with the ball screw and is rotatable in bearings 160 mounted in a support 162 fixed to the top of the movable beam 106.

The movable beam 106 also carries a numerically-controlled electric servomotor 164 which rotates the female thread 158 by means of a transmission 166, for example a toothed belt.

As in the aforementioned patent application of the same date, once the movable beam 106 has completed its approach stroke by the devices 112, 114, 146, the servomotor 164 corresponding to each C-shaped structure 122 is operated so as to thrust the wedge 154 between the two wedging surfaces 146 and 152 and thus effect the bending stroke.

As in the embodiment of FIGS. 2 to 5, all the servomotor units are substantially identical from the kinematic point of view, and the only difference is that the servomotors of the units 138 situated at the ends of the beam are adapted to exert a thrust force of $P/n(n-1)$, where n is the number of C-shaped structures 122, whilst the servomotors of the units 140 corresponding to the intermediate structures 122 are adapted to exert a thrust force of $P/(n-1)$ on the movable beam 106.

In the embodiment of FIGS. 7 to 9, each C-shaped structure 122 is also provided with auxiliary detection structures 170 and 172, both of which are C-shaped. The structure 170, which measures the relative displacement of the punch and the die, includes a lower arm 174 fixed to the lower beam 102 and an upper arm 176 which carries an opto-electronic transducer 178 cooperating with an optical line 180.

The other auxiliary structure 172 measures the deformation of the structure 122 and is necessary since, in the case in question, the movable beam 106 is continuous. This structure 172 comprises a lower arm 180 fixed to the lower arm of the C-shaped structure 122 and an upper arm 182 which carries a transducer 184 for detecting the deformation of the structure 122 so as to identify the zero position, when the punch 108 and the die 104 are in contact with each other, for the servosystem of each of the C-shaped structures 122.

Although a preferred embodiments are specifically illustrated and described herein, it will be appreciated that many modifications and variations of the present invention are possible in light of the above teachings and within the purview of the appended claims without departing from the spirit and intended scope of the invention.

For example, in the bending machine shown in FIGS. 2 to 5 and FIGS. 6 to 9, the upper beam may be fixed and the lower beam may be movable vertically in the general planes.

What is claimed is:

1. A sheet workpiece bending machine comprising:

upper and lower bending tools having a long and narrow shape defining a longitudinal direction of the bending tools, with the bending tools defining in the longitudinal direction at least three sections, and relatively movable toward and away from each other, for bending a sheet workpiece interposed therebetween;

at least three supporting frames each provided to lie within one of three planes perpendicular to the longitudinal direction of the bending tools, the supporting frame supporting, through apron members, the upper and lower bending tools in a manner such that the bending tools are relatively movable toward and away from each other;

driving force exerting means, each mounted on one of the supporting frames, for exerting a driving force on the at least three sections in the longitudinal direction of the upper or the lower bending tools, in order to relatively move the upper and the lower tools toward and away from each other; and control means for controlling the driving force exerting means so that spacings between the upper and the lower tools, at least at the three sections of the bending tools, are maintained to be the same during actual bending operation.

2. The sheet workpiece bending machine of claim 1, wherein the control means comprises means for detecting the spacing between the upper and the lower bending tools at the three sections thereof; and a signal processing means for outputting a control signal to the driving force exerting means in accordance with a signal from the spacing detecting means.

3. The sheet workpiece bending machine of claim 2, wherein the apron member supporting the movable bending tools of the upper and lower bending tools, comprise a plurality of component members each having two edges, both edges of each component member being supported by two of the supporting frames.

4. The sheet workpiece bending machine of claim 2, wherein the driving force exerting means comprises an electric servomotor having a rotation axis and a ball screw coupled with the rotation axis of the servometer.

5. The sheet workpiece bending machine of claim 2, further comprising a means for detecting a deformation produced on the supporting frame due to a driving force applied thereto during actual bending operation.

6. The sheet workpiece bending machine of claim 5, wherein the apron member supporting the fixed bending tools of the upper and the lower bending tools, comprise a plurality of component members each having two edges, both edges of each component member being supported by two of the supporting frames.

* * * * *